United States Patent [19]

Seeger

[11] Patent Number: 4,530,863

[45] Date of Patent: Jul. 23, 1985

[54] ART OBJECTS AND METHODS OF PRODUCING SAME

[76] Inventor: Richard W. Seeger, 7307 E. Cypress, Scottsdale, Ariz. 85257

[21] Appl. No.: 472,210

[22] Filed: Mar. 4, 1983

[51] Int. Cl.[3] ..... B44C 3/06

[52] U.S. Cl. ..... 428/13; 40/160; 156/58; 428/542.4

[58] Field of Search ..... 428/13, 16, 542.4; 156/58, 59; 40/160; 430/644

[56] References Cited

U.S. PATENT DOCUMENTS

| | | | |
|---|---|---|---|
| 1,512,010 | 10/1924 | Runcie | 428/13 |
| 1,839,889 | 1/1932 | Palais | 29/428 X |
| 3,868,283 | 2/1975 | Scheyer | 428/13 X |
| 3,879,874 | 4/1975 | Broussard, Sr. | 40/160 X |
| 4,161,831 | 7/1979 | Restle | 428/13 X |
| 4,378,392 | 3/1983 | Segel | 428/483 X |

*Primary Examiner*—Henry F. Epstein

*Attorney, Agent, or Firm*—Richard R. Mybeck

[57] ABSTRACT

A unique art object comprising multiple photographic images reflecting the vocational and avocational interests and personality traits of a featured person or group, each image being mounted upon a rigid plastic dimensionally stable backing and provided with a mounting surface for mating with and adherence to a base member to define a pleasing and meaningful pattern, either alone or in combination with a symbolic background. Special methods of preparing each image, securing each image to a backing, preparing the sculpture base and securing the backed images to the sculpture base in a preselected arrangement to form a completed art object are described.

9 Claims, 5 Drawing Figures

10
11
12
13
14
15

ART OBJECTS AND METHODS OF PRODUCING SAME

BACKGROUND OF INVENTION

This invention relates to methods and techniques for utilizing in a unique and synergistic manner, a combination of photographic, mechanical, chemical and artistic skills to create a meaningful and novel sculpture depicting the vocational and avocational interests and personality traits of a featured person or a related group and provide a long lasting and treasured art object as a living memorial to the person or persons featured therein. According to the best information available, no such object or any object analogous thereto existed prior to this invention.

SUMMARY OF INVENTION

The present invention provides a new and unique personalized portrait of an individual in which the vocational and avocational interest of that person are combined with selected personality traits in a plurality of photographic images which are then utilized to provide a sculptured life-simulating and meaningful presentation of that person as an elegant and treasurable art object. The methods and techniques herein described and illustrated are equally useful to create and produce a photostatuary of a related group.

Further, the present invention provides new and useful techniques combining photographic, mechanical, chemical and artistic skills to produce a unique sculptured portrait of an individual comprising producing a plurality of individualized photographs depicting a variety of interests and characteristic postures of a selected individual; selecting a desired number of said photographs for use in the sculpture; mounting the selected photographs upon a dimensionally stable acrylic backing with a special adhesive to obtain completely smooth and even mating surface between the picture and the backing; trimming the mounted photograph to contour the photographic image; providing the trimmed-backed-image with a flat mounting surface positioned in such a manner that when the image is fused into the sculpture base at its predetermined location, the angular relationship of the image relative to the base will be as desired; mounting each of the several images to the sculpture base, with each at its predetermined location, applying solvent between the mounting surface of the image and the upper surface of the base to cause said image and said base to chemically fuse into a mated integral relationship; and fusing, when desired, a symbolic background or slogan disposed upon an acrylic member to the base in its preselected location to complete the sculpture.

The principal object of the present invention is to provide a novel, unique and pleasing photosculpture and methods and techniques of producing same.

DRAWINGS

In the drawings, in which like elements bear like identification throughout the several views, FIG. 1 is an isometric showing of a sculptured art object embodying the present invention;

DESCRIPTION OF PREFERRED EMBODIMENT

Figures 1, 2, 3:
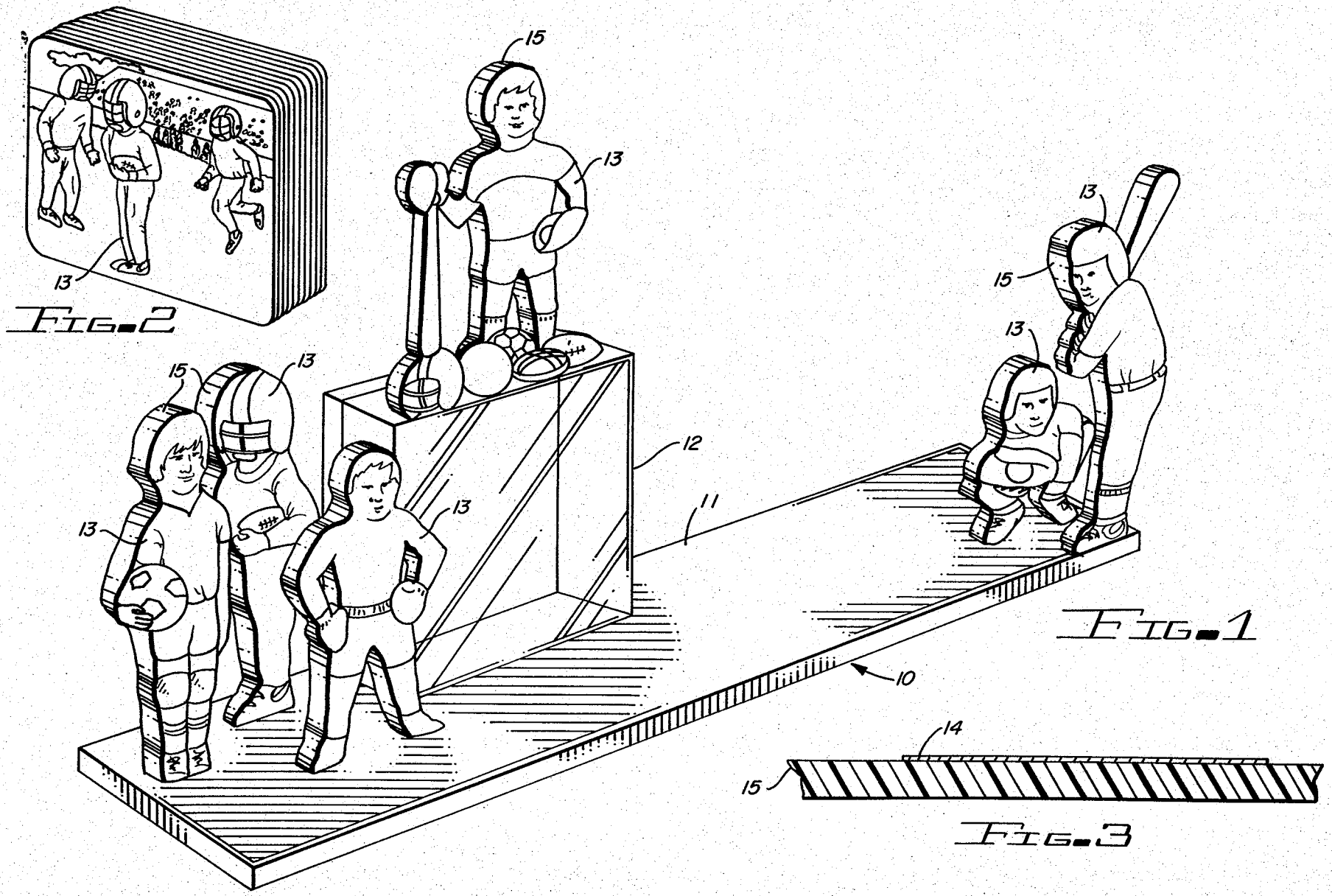
FIG. 2 shows a plurality of photographic images from which the images appearing in the finished art object are selected.
FIG. 3 is a cross-section showing the mounting of a preselected photograph to a dimensionally stable backing in accordance herewith.

Referring to the drawing, a preferred embodiment of the present invention is shown in FIG. 1. Each art object 10 comprises a base member 11 to which is secured an optional mood setter or "back drop" 12 and a plurality of contour trimmed backed photographic images 13 strategically secured to base 11 to create an aesthetic and meaningful arrangement thereupon.

In one practice of the present invention, a number of photographs (see FIG. 2) are taken of an individual or a related group. Where proportionality among the several images is desired, each photograph should be taken at a common focal length although, as will later appear, this is not necessary when a random or special effect is desired. The photographs will record the selected subject in a variety of costumes, positions and poses precalculated to depict and reflect the subject's vocational and avocational interests and his/her photographable personality traits. Thus one person, for example, a young boy might choose to be photographed in his Pop Warner uniform, in his soccer uniform holding a ball, in his CYO boxing garb awaiting the bell, in his youth hockey outfit, (see FIG. 1) in his Boy Scout uniform, in his school clothes having a book carrier appropriately tucked under his arm, in his little league uniform in a batting posture or in his catcher's position or both, etc. Each of the several photographs which are selected will be prepared into figurines and mounted to the finished sculpture in the manner hereafter described.

The backdrop 12 can be an appropriate inanimate photograph such as a picture of the school building where the earlier described lad attends class, the court building in which a judicial type holds forth etc.; or it can be of nature such as the Grand Canyon where an outdoor type loves to roam etc. In some situations, backdrop 12 may be a replica of a motto or the like which is appropriate to the ultimate effect desired. In some sculptures, backdrop 12 may be eliminated if the sensibilities of the featured individual do not require the use of a symbolic background.

Once a preselected group of photographs have been taken in full color or in black and white, all of the photographs are viewed and some of them, usually somewhere between five and nine, are chosen for further processing. Each of the photographic images will obtain a common size when a common focal length is used to shoot each picture. When a variable focal length is used, the photographic images will be of various sizes and by the proper selection of focal length, dominant personality traits can be made to loom larger than others while subservient personality traits can be scaled to provide lesser impact.

In one practice of the invention, use of a 35 mm SLR camera at about ten feet from subject to camera lens will provide a highly useful image when printed as a so-called "jumbo print", that is, at about 4½ to about 4¾ inches. It is of course understood that other film sizes and focal lengths may be employed to achieve desirable results, the critical factor being that all photographs are produced using substantially the same focal length when it is desired that the size of the several images be essentially the same. If special effects are desired, that is, when certain images are intentionally rendered dominant in the overall presentation, simple adjustment of focal length can cause such dominant images to appear larger than the others when incorporated into the finished sculpture.

Having selected the photographic images to be incorporated into the finished sculpture which, as explained, will usually be proportioned to achieve equality of size among the several images, except where dominance is deliberately sought, the pictures are mounted to a dimensionally stable backing preferrably formed of an acrylic plastic such as methyl methacrylate which is available commercially as Plexiglass®, Lucite® and the like. While this plastic finds wide use as a transparent material, it is also available in both translucent and opaque forms. It is preferred to use the white plastic as the image-backing in most sculptures strictly for aesthetic reasons. Having said that, it will be observed that certain sculptures lend themselves to methyl methacrylate when tinted other colors. In such cases, the colored material works equally well structurally in the practice of the invention.

The rear surface of each photograph is coated with a thin uniform layer of an appropriate polyester resin cement admixed with a compatible catalyst and characterized by its non-reactivity to either the photographic paper or the colors therein, by its resistance to shrinking or bleeding and its ability to fully adhere at room temperature without the creation of disastrous air bubbles. A suitable adhesive is provided by a polyester resin glue containing an unsaturated polyester resin in a styrene monomer characterized by its medium reactivity, low viscosity and its resistance to air inhibition so that a room temperature cure is readily obtained. This resin is available commercially under the trade designation Polylam finishing resin 0819 from Anatex Plastics, Phoenix, Ariz. One compatible catalyst useful with the aforesaid polyester resin is methyl ethyl ketone peroxide in a dimethyl phthalate carrier. The resin-catalyst system, when cured at room temperature provides an interface having a Barcol hardness of 47, a tensile strength of 10,000 psi, a flexural strength of 13,000 psi and a flexural modulus of $5.7\times10^5$ psi.

While the foregoing represents my preferred choice for securing the photographs to the dimensionally stable backing, the so-called polyester laminating resins (which omit wax) can be used with satisfactory results.

After a thin layer of the polyester resin adhesive is applied uniformly as by brushing to the back of the photograph 14 and to the clean smooth sheet of dimensionally stable material 15, e.g., Plexiglass, the adhesive surfaces are engaged and the photograph is taped in position on the backing with masking tape or the like until the adhesive is dry. The uniformity of the adherence can be maximized by disposing a weighted object upon the photograph to effect a uniform weight distribution thereupon during the drying period.

Figure 4:
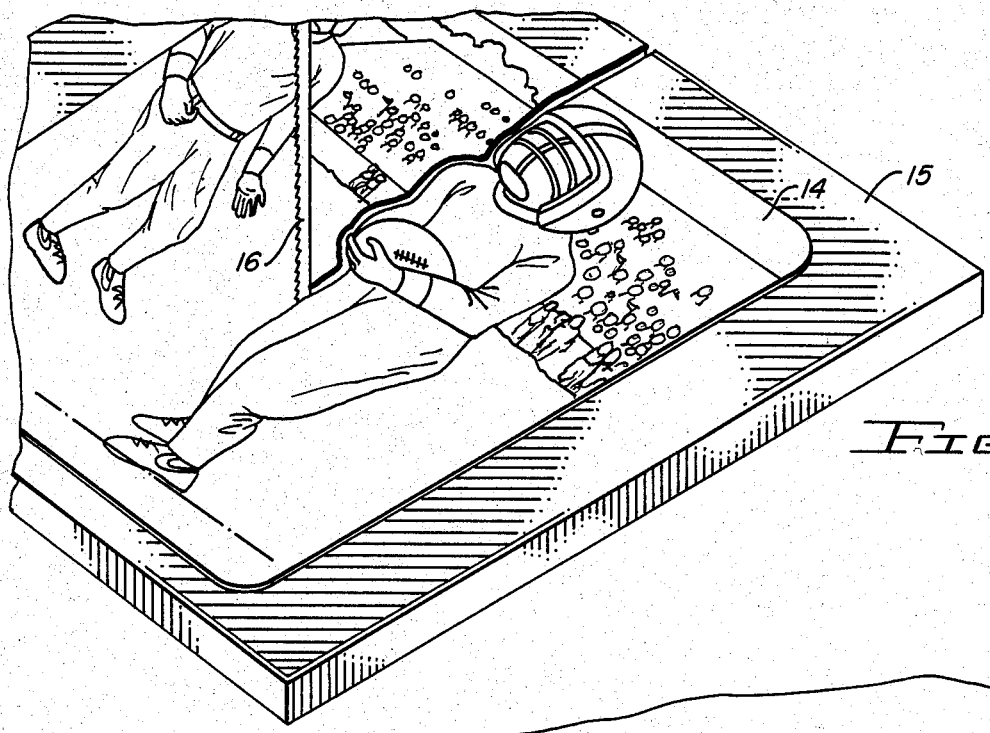
FIG. 4 is an isometric view showing the mounted photograph of FIG. 3, with the photographic image thereof partially trimmed to define the contour thereof.

Once the photograph 14 is permanently secured to the dimensionally stable backing 15 such as the methyl methacrylate backing shown in FIG. 3, the photographic image therein, such as the boy with his football, is trimmed using a suitable cutting instrument 16, such as band saw, a laser beam, a saber saw, an abrasive wire or the like until a complete contour cut is produced around the perimeter of the image (see FIG. 4) and all of the extraneous matter in the photograph is eliminated except for one portion 13, the function of which will now be described. The cutting device must be capable of achieving the desired cut without discoloring or damaging either the backing or the photograph.

Figure 5:
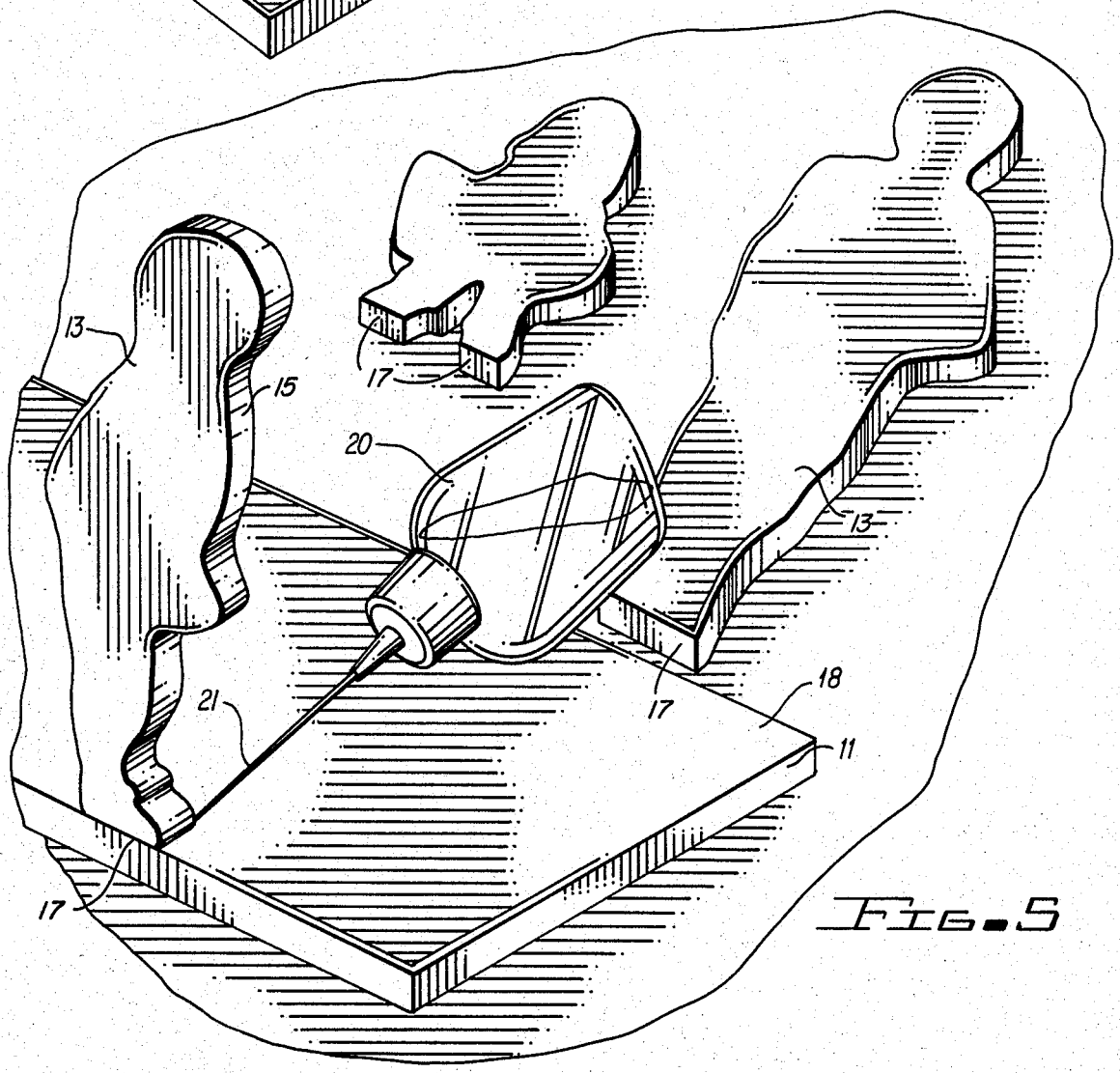
FIG. 5 is an isometric showing a plurality of trimmed photographic images having a mounting surface provided therefor in the process of being installed upon a sculpture base member.

When the image is in an upright or standing position, a straight cut 17 will be provided beneath the lowest point of the image at an angle normal to the vertical axis of the image. If the image is to be seated or kneeling or in a crouched position, the straight cut will still be provided adjacent and slightly beneath that portion of the figure which will normally be the first to engage the base. This cut, referred to herein as the "mounting surface" 17 is provided to mate with the upper surface 18 of the base member 11 when secured or welded thereto by application of a suitable solvent such as methylene chloride (denominated "MDC") or like materials the effect of which is to momentarily dissolve and then reset the acrylate whereby mounting surface 17 is literally fused to the upper surface 18 of base 11. A suitable device for delivering the solvent to the desired location is a bottle 20 having an elongated needle-like spout 21 as shown in FIG. 5.

Before fusing the several figurines to the base in their respective predetermined locations, it is a preferred practice to sand the mounting surface of each with very fine abrasive grit to assure the smoothness of the surface.

The placement procedure is repeated until each figurine is secured in its preselected location relative to the backdrop or setting member, if used, and to each other whereupon the pattern desired for the sculpture is created. In this manner, a semi-biographical representation relative to a fixed time frame is created in a visual and enduring manner. Alternatively, a historical representation relative to a fixed time is created when a group of persons is featured.

It is of course understood that the method, herein described and illustrated can be applied to create the novel are object hereof in any dimension or scale from the miniature herein described to a greater than life scale for use in museums or historic buildings without departing from the inventive spirit hereof. Likewise, a series of fixed focal length photographs can be prepared at fixed time intervals over a preselected life span to depict growth or change in the featured subject such as a growing child.

From the foregoing it is apparent that novel art objects and methods of producing the same have been herein described and illustrated which fulfill all of the aforesaid objectives in a remarkably unexpected fashion. It is of course understood that such modifications, alterations, and adaptations as may readily occur to the artisan confronted with this disclosure are intended within the spirit hereof which is limited only by the scope of the claims appended hereto.

Accordingly, what is claimed is:

1. An art object comprising: a base member; a plurality of discrete contoured photographic images preselected to depict varied vocational, avocational and personality traits of a featured person; a plurality of dimensionally stable backings, each contoured to conform to the contour of a different one of said photographic images and having a mounting surface defined thereupon, each one of said images being secured in registered relationship with a corresponding one of said dimensionally stable backings, each of said mounting surfaces being secured to said base member at a location predetermined for each of said backed images.

2. An art object according to claim 1 in which a mood-setting member is secured to said base member in aesthetic relation to said photographic images.

3. An art object according to claim 1 in which said dimensionally stable backing is composed of methyl methacrylate sheeting.

4. An art object according to claim 1 in which said base member is composed of methyl methacrylate sheeting.

5. The method of producing an art object having a base member, a plurality of discrete contoured photographic images preselected to depict varied vocational, avocational and personality traits of a featured person, each secured to a dimensionally stable backing having a mounting surface defined thereupon, said mounting surface being secured to said base member at a location predetermined for each of said images, comprising the steps of producing a plurality of conceptually coordinated photographic images; selecting a desired number of said photographs; mounting each of said desired number of said photographs upon an independent dimensionally stable backing; trimming each said mounted photograph along the contour of said image; cutting a mounting surface upon each of said contour-cut backed images; and fusing each said mounting surface to a position upon a sculpture base predetermined to provide a pleasing arrangement between the several images.

6. A method according to claim 5 in which a symbolic background is secured to said base member in aesthetic relationship to each of said several images.

7. A method according to claim 5 in which each said contour-cut backed image is fused to said base member in its predetermined location by applying methylene chloride to said mounting surface of said backed image and to said predetermined location; immediately engaging said mounting surfaces with said predetermined location; and maintaining said engaged position until said fusion is complete.

8. A method according to claim 5 in which said photograph is mounted to said backing by applying a thin uniform layer of catalyst activated unsaturated polyester resin in a styrene monomer to the back of said photograph; applying a thin uniform layer of said resin on the surface of said backing; engaging said resin layers in complete surface-to-surface engagement; and maintaining said layers in said engaged position until said resin is cured.

9. A method according to claim 8 in which a uniform pressure is applied to said mated resin surfaces while said resin is curing.

* * * * *